US011004406B1

(12) United States Patent
Wu

(10) Patent No.: US 11,004,406 B1
(45) Date of Patent: May 11, 2021

(54) DUAL LIQUID CRYSTAL DISPLAY DEVICE

(71) Applicant: HIMAX TECHNOLOGIES LIMITED, Tainan (TW)

(72) Inventor: Tung-Ying Wu, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 16/734,392

(22) Filed: Jan. 5, 2020

(51) Int. Cl.
*G09G 3/34* (2006.01)
*G09G 3/36* (2006.01)

(52) U.S. Cl.
CPC ..... *G09G 3/3406* (2013.01); *G09G 3/3607* (2013.01); *G09G 2300/023* (2013.01); *G09G 2320/0233* (2013.01); *G09G 2320/0653* (2013.01)

(58) Field of Classification Search
CPC ..... G09G 3/3406; G09G 3/3607; G09G 2320/0653; G09G 2320/0233; G09G 2300/023
See application file for complete search history.

(56) References Cited

U.S. PATENT DOCUMENTS

2009/0051707 A1* 2/2009 Hirata ..... G09G 3/3648 345/690
2010/0118006 A1* 5/2010 Kimura ..... G09G 3/3611 345/205
2012/0224121 A1* 9/2012 Gilbert ..... G09G 3/3426 349/64
2014/0049571 A1* 2/2014 Erinjippurath ..... G02F 1/13471 345/690
2016/0170702 A1* 6/2016 Jiang ..... G02F 1/133528 345/618
2016/0180782 A1* 6/2016 Nakaya ..... G09G 3/3648 345/690
2017/0032744 A1* 2/2017 Yoo ..... G02F 1/133512
2017/0092216 A1* 3/2017 Park ..... G09G 3/36
2017/0343839 A1* 11/2017 Nam ..... G09G 3/3406

FOREIGN PATENT DOCUMENTS

CN 104297993 A 1/2015
CN 108877694 A 11/2018
CN 109828417 A 5/2019

* cited by examiner

*Primary Examiner* — David Tung
(74) *Attorney, Agent, or Firm* — CKC & Partners Co., LLC

(57) ABSTRACT

A dual LCD device includes a gray LCD, a color LCD stacked on the gray LCD, a backlight assembly disposed at the rear of the gray LCD, and a controller. The controller is configured to receive an input image data and then respectively output a gray cell pixel data and a color cell pixel data to the gray LCD and the color LCD based on a dual cell dimming algorithm. The dual cell dimming algorithm is configured to alleviate a moiré effect caused by light interference between the gray LCD and the color LCD. The dual cell dimming algorithm includes: calculating an initial gray cell pixel data based on the input image data; calculating the gray cell pixel data by spatially blurring the initial gray cell pixel data; and calculating the color cell pixel data by compensating the gray cell pixel data.

6 Claims, 8 Drawing Sheets

Initial Gray Cell Pixel Data

BLK

PX

| | | | | |
|---|---|---|---|---|
| 50 | 50 | 100 | 100 | 100 |
| 50 | 50 | 100 | 100 | 100 |
| 50 | 50 | 100 | 100 | 100 |
| 50 | 50 | 100 | 100 | 100 |
| 50 | 50 | 100 | 100 | 100 |

x

Weighting Table

| | | | | |
|---|---|---|---|---|
| 1 | 1 | 1 | 1 | 1 |
| 1 | 2 | 2 | 2 | 1 |
| 1 | 2 | 4 | 2 | 1 |
| 1 | 2 | 2 | 2 | 1 |
| 1 | 1 | 1 | 1 | 1 |

FIG. 4

| | | | | | |
|---|---|---|---|---|---|
| H | L | H | L | H | L |
| L | H | L | H | L | H |
| H | L | H | L | H | L |
| L | H | L | H | L | H |

FIG. 6

DUAL LIQUID CRYSTAL DISPLAY DEVICE

BACKGROUND

Field of Invention

The present invention relates to a dual liquid crystal display (LCD) device. More particularly, the present invention relates to a dual LCD device for alleviating a moiré effect.

Description of Related Art

LCD devices have the advantage of realizing a higher definition with a lower power dissipation and are used for a wide range of applications from a small-screen cellular phone to a large-screen television monitor. However, there is a defect in the LCD device that the contrast ratio of the LCD panel alone in a dark environment is lower than that of a CRT and/or a plasma display panel.

One of the known technologies for solving the aforementioned problem is to adopt a multi-panel LCD structure in a LCD device, such as a dual cell LCD TV, wherein two or more LCD panels are stacked one on another is employed in the LCD device, to reduce the black luminance, i.e., luminance upon display of dark image, thereby improving the total contrast ratio of the LCD device. However, the deviation of the pixels generates a bright area and a dark area which are arranged periodically, to generate an interference pattern such as a moiré effect. Thus, the image quality of this LCD device is degraded.

One of the known means to elimination the moiré effect is to apply a diffuser sheet between the LCD panels so as to blur the distribution of the light intensity. However, the use of the diffuser sheet causes an additional process for manufacturing this LCD device and increases the cost of this LCD device.

SUMMARY

The present invention provides a dual LCD device including a gray LCD, a color LCD, a backlight assembly, and a controller. The gray LCD and the color LCD are stacked one on another. The backlight assembly is disposed at the rear of the gray LCD and configured as a display light source for the dual LCD device. The controller is configured to receive an input image data and then respectively output a gray cell pixel data and a color cell pixel data to the gray LCD and the color LCD based on a dual cell dimming algorithm. The dual cell dimming algorithm is configured to alleviate a moiré effect caused by light interference between the gray LCD and the color LCD. The dual cell dimming algorithm includes: calculating an initial gray cell pixel data based on the input image data; calculating the gray cell pixel data by spatially blurring the initial gray cell pixel data; and calculating the color cell pixel data by compensating the gray cell pixel data.

In accordance with one or more embodiments of the invention, the gray LCD includes plural first pixels. The initial gray cell pixel data includes plural first gray level values respectively corresponding to the first pixels. The color LCD includes plural second pixels. The input image data includes plural second gray level values respectively corresponding to the second pixels. One of the first gray level values corresponding to one of the first pixels is an average of the second gray level values corresponding to the second pixels overlapping the one of the first pixels.

In accordance with one or more embodiments of the invention, the gray LCD includes plural first pixels. The initial gray cell pixel data includes plural first gray level values respectively corresponding to the first pixels. The spatially blurring the initial gray cell pixel data includes: selecting a block including n*n first pixels of the gray LCD with one of the first pixels in a center of the block, in which n is an odd integer larger than 1; multiplying the first gray level values of the first pixels within the block by n*n weighted values of a weighting table, respectively, thereby obtaining plural weighted first gray level values; and dividing a sum of the weighted first gray level values by a sum of the weighted value so as to obtain a spatially blurring first gray level value of the one of the first pixels. The gray cell pixel data includes the spatially blurring first gray level value.

In accordance with one or more embodiments of the invention, one of the weighted values located at a first position of the weighting table is larger than another one of the weighted values located at a second position of the weighting table. The first position is closer to a center of the weighting table than the second position.

The present invention also provides a dual LCD device including a gray LCD, a color LCD, a backlight assembly, and a controller. The gray LCD and the color LCD are stacked one on another. The gray LCD includes plural first pixels. The backlight assembly is disposed at the rear of the gray LCD and configured as a display light source for the dual LCD device. The controller is configured to receive an input image data and then respectively output a gray cell pixel data and a color cell pixel data to the gray LCD and the color LCD based on a dual cell dimming algorithm. The dual cell dimming algorithm is configured to alleviate a moiré effect caused by light interference between the gray LCD and the color LCD. The dual cell dimming algorithm further includes: calculating an initial gray cell pixel data based on the input image data, in which the initial gray cell pixel data includes plural first gray level values respectively corresponding to the first pixels; calculating the gray cell pixel data by spatially blurring the first gray level values of the initial gray cell pixel data, in which the gray cell pixel data includes the spatially blurring first gray level values; and calculating the color cell pixel data by compensating the gray cell pixel data; setting a first high pixel and a first low pixel of the first pixels to be in a high state and a low state, respectively, in which the first high pixel and the first low pixel are adjacent to each other; and updating the spatially blurring first gray level values by increasing the spatially blurring first gray level value of the first high pixel based on a high state lookup table and decreasing the spatially blurring first gray level value of the first low pixel based on a low state lookup table, so as to update the gray cell pixel data including the updated spatially blurring first gray level values.

In accordance with one or more embodiments of the invention, the color LCD includes plural second pixels. The input image data includes plural second gray level values respectively corresponding to the second pixels. One of the first gray level values corresponding to one of the first pixels is an average of the second gray level values corresponding to the second pixels overlapping the one of the first pixels.

In accordance with one or more embodiments of the invention, the spatially blurring the initial gray cell pixel data includes: selecting a block including n*n first pixels of the gray LCD with one of the first pixels in a center of the block, in which n is an odd integer larger than 1; multiplying the first gray level values of the first pixels within the block by n*n weighted values of a weighting table, respectively, thereby obtaining plural weighted first gray level values; and dividing a sum of the weighted first gray level values by a sum of the weighted value so as to obtain one of the spatially blurring first gray level value of the one of the first pixels.

In accordance with one or more embodiments of the invention, one of the weighted values located at a first position of the weighting table is larger than another one of the weighted values located at a second position of the weighting table. The first position is closer to a center of the weighting table than the second position.

In accordance with one or more embodiments of the invention, the high state lookup table corresponds to a high state curve and the low state lookup table corresponds to a low state curve. The high state curve and the low state curve are fitted to a gamma curve.

In accordance with one or more embodiments of the invention, the dual cell dimming algorithm further includes: respectively setting the first high pixel and the first low pixel of the first pixels to be in the low state and the high state in a next frame subsequent to a current frame; and updating the spatially blurring first gray level values in the next frame by decreasing the spatially blurring first gray level value of the first high pixel based on the low state lookup table and increasing the spatially blurring first gray level value of the first low pixel based on the high state lookup table so as to update the gray cell pixel data including the updated spatially blurring first gray level values in the next frame.

BRIEF DESCRIPTION OF THE DRAWINGS

The invention can be more fully understood by reading the following detailed description of the embodiment, with reference made to the accompanying drawings as follows:

FIG. 4 provides an example for illustrating a process for spatially blurring initial gray cell pixel data according to the first embodiment of the present invention.

FIG. 6 provides an example of spatial high/low assignment according to the second embodiment of the present invention.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size. The using of "first", "second", "third", etc. in the specification should be understood for identify units or data described by the same terminology, but are not referred to particular order or sequence.

Figure 1:
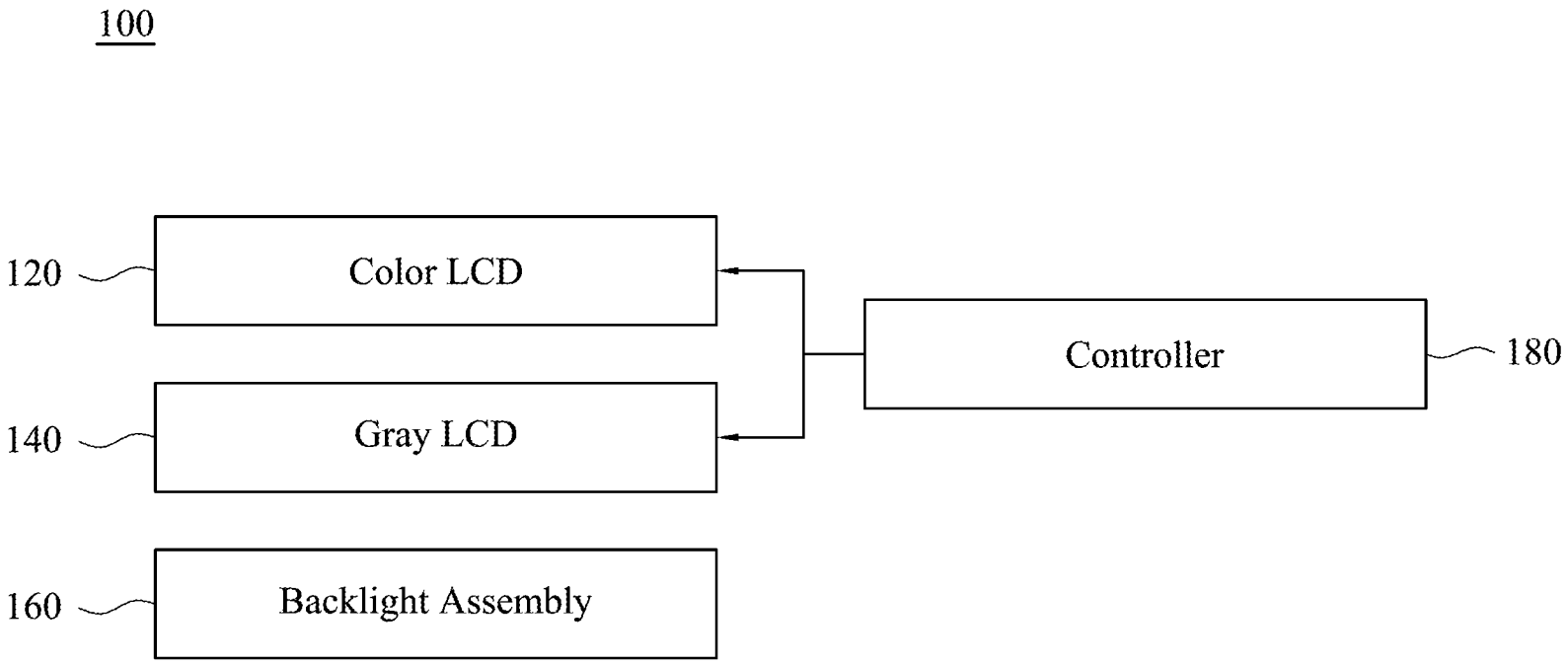
FIG. 1 illustrates a dual liquid crystal display (LCD) device according to some embodiments of the present invention.

FIG. 1 illustrates a dual liquid crystal display (LCD) device 100 according to some embodiments of the present invention. The dual LCD device 100 includes a color LCD 120, a gray LCD 140, a backlight assembly 160, and a controller 180. The color LCD 120 and the gray LCD 140 are stacked one on another. The backlight assembly 160 is disposed at the rear of the gray LCD 140 and configured as a display light source for the dual LCD device 100. Specially, the backlight assembly 160 includes a light source (such as fluorescent lamps or LED lamps) and optical elements to direct the light through the gray LCD 140 and the color LCD 120. In some embodiments of the present invention, the dual LCD device 100 is a dual cell LCD TV, the color LCD 120 is a 4K UHD (Ultra High Definition) RGB color LCD, the gray LCD 140 is a FHD (Full High Definition) gray LCD, however, the present invention is not limited thereto. Specifically, the color LCD 120 is used for displaying image and thus having a higher resolution, the gray LCD 140 is used for dimming and thus having a lower resolution.

In some embodiments of the present invention, the gray LCD 140 includes 1920×1080 pixels (hereinafter referred to as "first pixels"), the color LCD 120 includes 3840×2160 pixels (hereinafter referred to as "second pixels"), however, the present invention is not limited thereto. Therefore one of the first pixels of the gray LCD 140 with 1920×1080 first pixels overlaps four of the second pixels of the color LCD 120 with 3840×2160 second pixels.

As shown in FIG. 1, the controller 180 is electrically connected to the color LCD 120 and the gray LCD 140. The controller 180 is also called a timing controller (TCON). The controller 180 receives input image data for displaying on the dual LCD device 100 and correspondingly drives the color LCD 120 and the gray LCD 140. Taking the color LCD 120 for example, the color LCD 120 includes plural subpixels, each of the subpixels includes a TFT (Thin Film Transistor), a subpixel electrode, and a common electrode. Gate electrode of the TFT is electrically connected to a gate driver of the color LCD 120 through a gate line. Source electrode of the TFT is electrically connected to a source driver of the color LCD 120 through a data line. The controller 180 transmits corresponding voltage signal to the color LCD 120 so as to drive the source driver of the color LCD 120.

Figure 2:
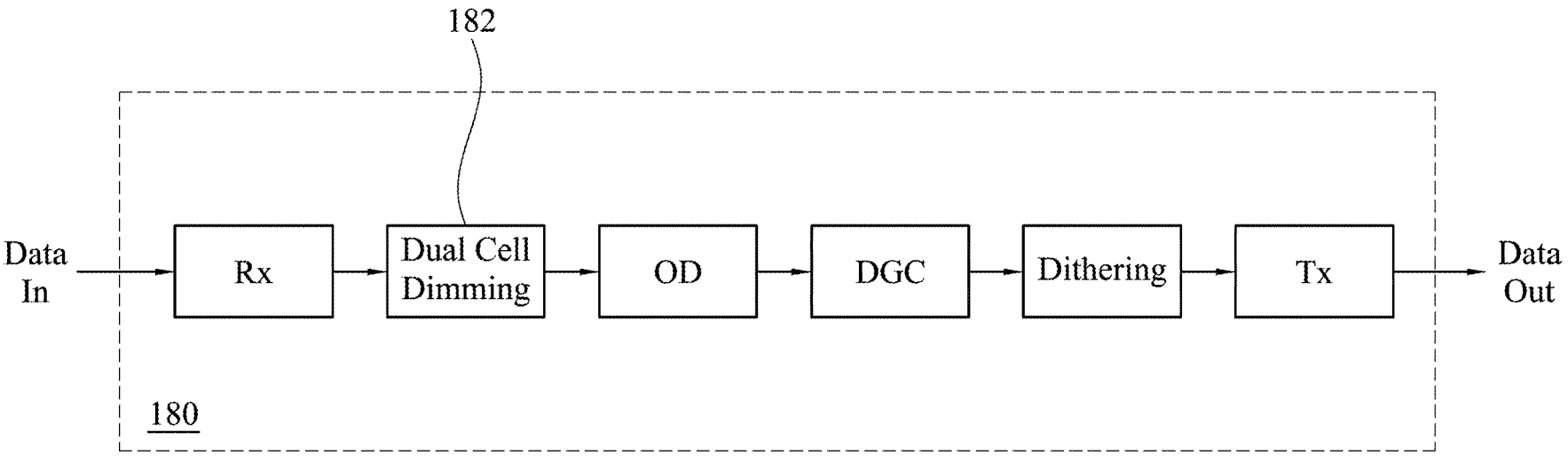
FIG. 2 illustrates a block diagram of a controller of the dual LCD device according to some embodiments of the present invention.

FIG. 2 illustrates a block diagram of the controller 180 of the dual LCD device 100 according to some embodiments of the present invention. The controller 180 receives input image data (shown as "Data In" in FIG. 2) and transmits corresponding voltage signal (shown as "Data Out" in FIG. 2) to the dual LCD device 100. The controller 180 includes a receiver (Rx) unit, a dual cell dimming unit 182, an OD (over drive) unit, a DGC (Digital Gamma Calibration) unit, a dithering unit, and a transmitter (Tx) unit.

In some embodiments of the present invention, the dual cell dimming unit 182 is configured to alleviate or even eliminate a moiré effect occurring on the dual LCD device 100 caused by light interference between the color LCD 120 and the gray LCD 140. Specifically, the dual cell dimming unit 182 of the controller 180 of the dual LCD device 100 is configured to receive the input image data and then respectively output a color cell pixel data and a gray cell pixel data to the color LCD 120 and the gray LCD 140 (i.e., outputting one corresponding voltage signal to the source driver of the color LCD 120 and outputting another corresponding voltage signal to a source driver of the gray LCD 140) based on a dual cell dimming algorithm executed by the dual cell dimming unit 182.

Figure 3:
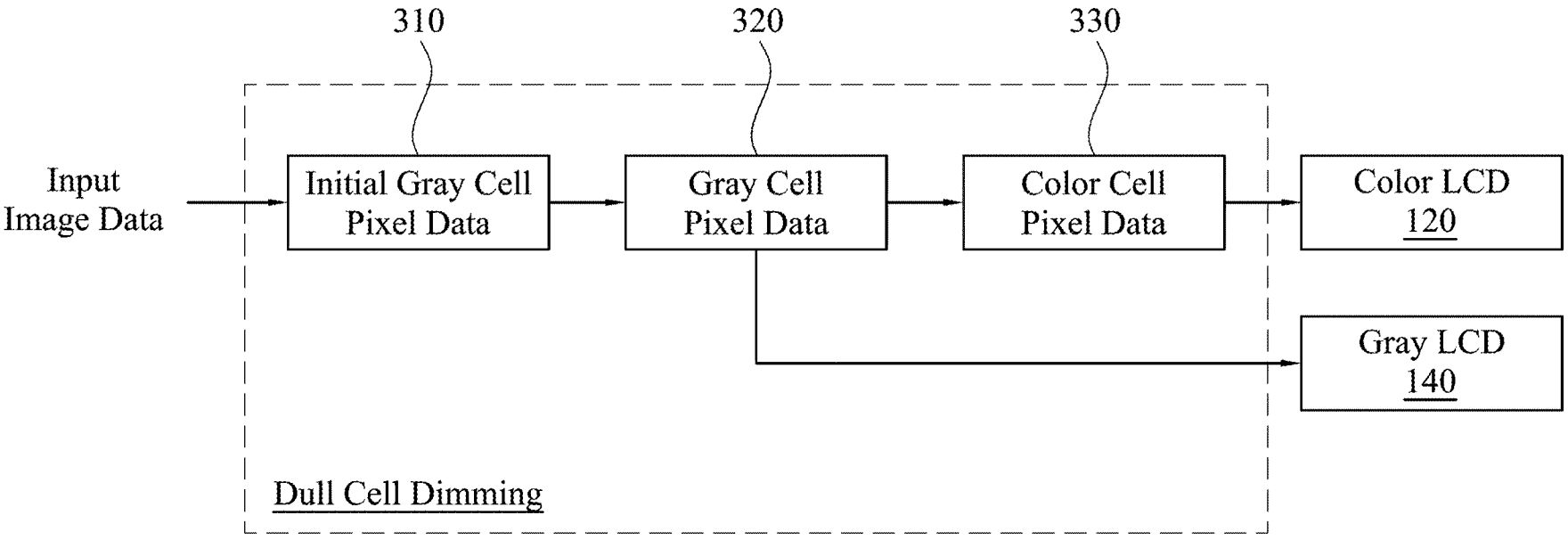
FIG. 3 illustrates a block diagram of the dual cell dimming unit of the controller of the dual LCD device according to a first embodiment of the present invention.

FIG. 3 illustrates a block diagram of the dual cell dimming unit 182 of the controller 180 of the dual LCD device 100 according to a first embodiment of the present invention. First, in block 310, the dual cell dimming unit 182 calculates an initial gray cell pixel data based on the input image data. The initial gray cell pixel data includes plural gray level values (hereinafter referred to as "first gray level values") respectively corresponding to the first pixels of the gray LCD 140. The input image data includes plural gray level values (hereinafter referred to as "second gray level values") respectively corresponding to the second pixels of the color LCD 120. In the first embodiment of the present invention, one of the first gray level values corresponding to one of the first pixels of the gray LCD 140 is an average of the second gray level values corresponding to the second pixels of the color LCD 120 overlapping the one of the first pixels of the gray LCD 140. For example, in a case that one of the first pixels of the gray LCD 140 overlaps four of the second pixels of the color LCD 120, if four of the second gray level values corresponding to four of the second pixels of the color LCD 120 are 100, 100, 80, 80, then one of the first gray level values corresponding to one of the first pixels of the gray LCD 140 overlaps the four of the second pixels of the color LCD 120 is 90=(100+100+80+80)/4.

Referring to FIG. 3, after obtaining the initial gray cell pixel data, in block 320, the dual cell dimming unit 182 calculates the gray cell pixel data by spatially blurring the initial gray cell pixel data. In other words, in the first embodiment of the present invention, an image expected to be presented on the gray LCD 140 is spatially blurred so as to alleviate the moiré effect occurring on the dual LCD device 100 caused by light interference between the color LCD 120 and the gray LCD 140. A process for spatially blurring the initial gray cell pixel data includes: selecting a block including n*n first pixels of the gray LCD 140 with one of the first pixels in a center of the block; multiplying the first gray level values of the first pixels within the block by n*n weighted values of a weighting table, respectively, thereby obtaining plural weighted first gray level values; and dividing a sum of the weighted first gray level value by a sum of the weighted value so as to obtain a spatially blurring first gray level value of the one of the first pixels. In which, n is an odd integer larger than 1. The gray cell pixel data includes the spatially blurring first gray level value.

FIG. 4 provides an example for illustrating a process for spatially blurring the initial gray cell pixel data according to the first embodiment of the present invention. In a case as shown in FIG. 4, n=5, and a block BLK including 5*5 first pixels of the gray LCD 140 with one of the first pixels (i.e., PX) in a center of the block BLK is selected. The first gray level values of the first pixels corresponding to the initial gray cell pixel data within the block BLK are respectively multiplied by 5*5 weighted values of a weighting table, thereby obtaining plural weighted first gray level values (i.e., 1×50, 1×50, 1×100, 1×100, 1×100, 1×50, 2×50, 2×100, 2×100, 1×100, 1×50, 2×50, 4×100, 2×100, 1×100, lx 50, 2×50, 2×100, 2×100, 1×100, 1×50, 1×50, 1×100, 1×100, 1×100). A sum of the weighted first gray level value is divided by a sum of the weighted value (i.e., 36=1+1+1+1+1+1+2+2+2+1+1+2+4+2+1+1+2+2+2+1+1+1+1+1+1) so as to obtain a spatially blurring first gray level value of the one of the first pixels (i.e., PX), that is, the spatially blurring first gray level value of the first pixels is 82≈(1/36)×(1×50+1×50+1×100+1×100+1×100+1×50+2×50+2×100+2×100+1×100+1×50+2×50+4×100+2×100+1×100+1×50+2×50+2×100+2×100+1×100+1×50+1×50+1×100+1×100+1×100).

It is noted that one of the weighted values located at a first position of the weighting table is larger than another one of the weighted values located at a second position of the weighting table, and the first position is closer to a center of the weighting table than the second position. As shown in FIG. 4, one of the weighted values located at a center of the weighting table is 4, another of the weighted values located at an edge of the weighting table is 1, yet another of the weighted values located between the center and the edge of the weighting table is 2.

It is worth mentioning that if the first pixel PX located at the center of the selected block BLK is located at or close to the edge of the gray LCD 140, the block BLK may contain several positions which do not include first pixels, then the first gray level values of that position is repeated with the first gray level value of the first pixel closest to that position.

Referring to FIG. 3, after obtaining the gray cell pixel data, in block 330, the dual cell dimming unit 182 calculates the color cell pixel data by compensating the gray cell pixel data. Specifically, the color cell pixel data outputted to the color LCD 120 is configured to compensate (e.g., by color correction) for variations in color of the light transmitted by the gray LCD 140 (to the color LCD 120). In other words, the visual effect for the input image data displaying on the single LCD is the same as the composited visual effect for the gray cell pixel data and the color cell pixel data respectively displaying on the gray LCD 140 and the color LCD 120 of the dual LCD device 100. In the first embodiment of the present invention, the corresponding gray level values of the color cell pixel data is obtained based on a pixel gain lookup table. Specifically, the corresponding gray level values of the color cell pixel data is calculated by multiplying the second gray level values with a pixel data gain extracted from the pixel gain lookup table. For example, when the dual cell dimming unit 182 finds the spatially blurring first gray level value of the first pixels is 82, the dual cell dimming unit 182 may correspondingly search the pixel gain lookup table so as to extract that the pixel data gain is 1.5, and then the dual cell dimming unit 182 calculates the corresponding gray level values of the color cell pixel data by multiplying the second gray level values which are 100, 100, 80, 80 with the pixel data gain which is 1.5, and therefore the corresponding gray level values of the color cell pixel data are 150, 150, 120, 120. It is noted that when the spatially blurring first gray level value of the first pixels is 0, the pixel data gain extracted from the pixel gain lookup table is 4, and when the spatially blurring first gray level value of the first pixels is 255, the pixel data gain extracted from the pixel gain lookup table is 1. Therefore, the range of the pixel data gain is from 1 to 4, and the pixel data gains of the pixel gain lookup table are related to a curve with a gamma value of 2.2.

Figure 5:
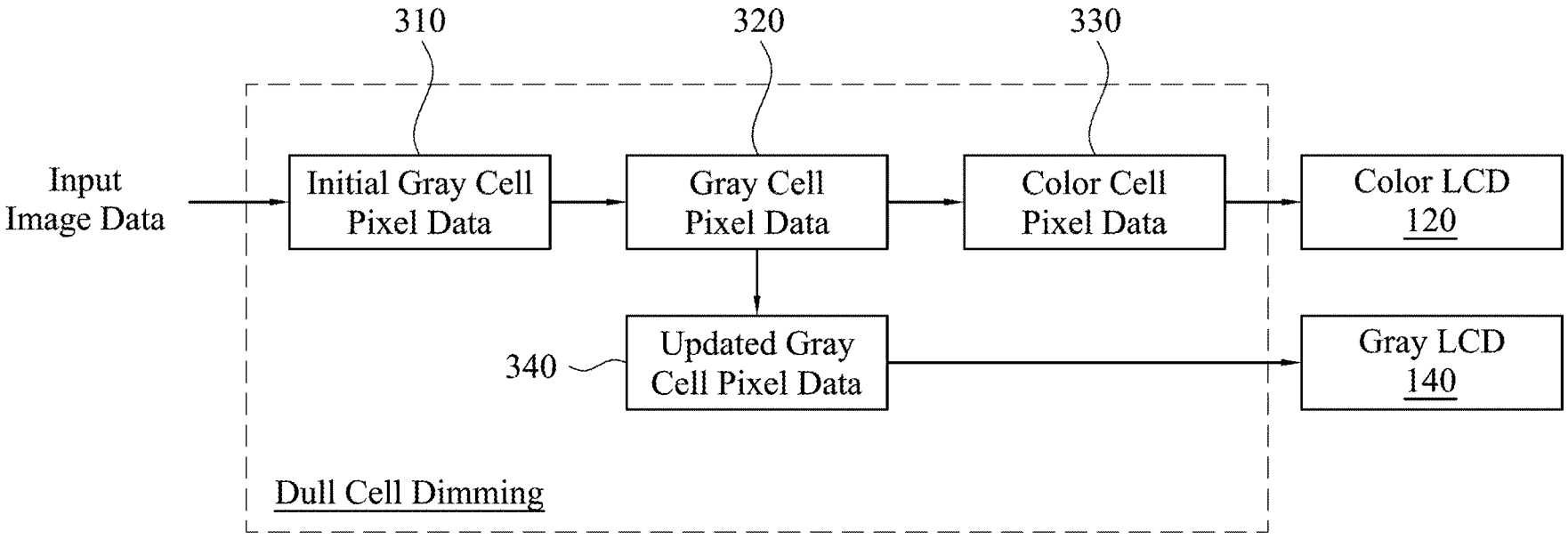
FIG. 5 illustrates a block diagram of the dual cell dimming unit of the controller of the dual LCD device according to a second embodiment of the present invention.

FIG. 5 illustrates a block diagram of the dual cell dimming unit 182 of the controller 180 of the dual LCD device 100 according to a second embodiment of the present invention. In the second embodiment of the present invention, the dual cell dimming unit 182 also calculates the initial gray cell pixel data based on the input image data in block 310, and the dual cell dimming unit 182 also calculates the gray cell pixel data by spatially blurring the initial gray cell pixel data in block 320, and the dual cell dimming unit 182 also calculates the color cell pixel data by compensating the gray cell pixel data in block 330. It is noted that the calculations of the blocks 310-330 in the first embodiment of the present invention is same as the calculations of the blocks 310-330 in the second embodiment of the present invention, and is not described again. Referring to FIG. 5, after obtaining the gray cell pixel data, in block 340, the dual cell dimming unit 182 may update the gray cell pixel data by a process of spatial high/low assignment. The process of spatial high/low assignment includes: setting two adjacent first pixel (hereinafter referred to as "first high pixel" and "first low pixel") to be in a high state and a low state, respectively; and updating the spatially blurring first gray level values of the gray cell pixel data by increasing the spatially blurring first gray level value of the first high pixel based on a high state lookup table and decreasing the spatially blurring first gray level value of the first low pixel based on a low state lookup table, so as to update the gray cell pixel data. The updated gray cell pixel data includes the updated spatially blurring first gray level values. FIG. 6 provides an example of spatial high/low assignment according to the second embodiment of the present invention. As shown in FIG. 6, a table of plural states of plural first pixels is presented, "H" represents the high state and "L" represents the low state.

Figure 7:
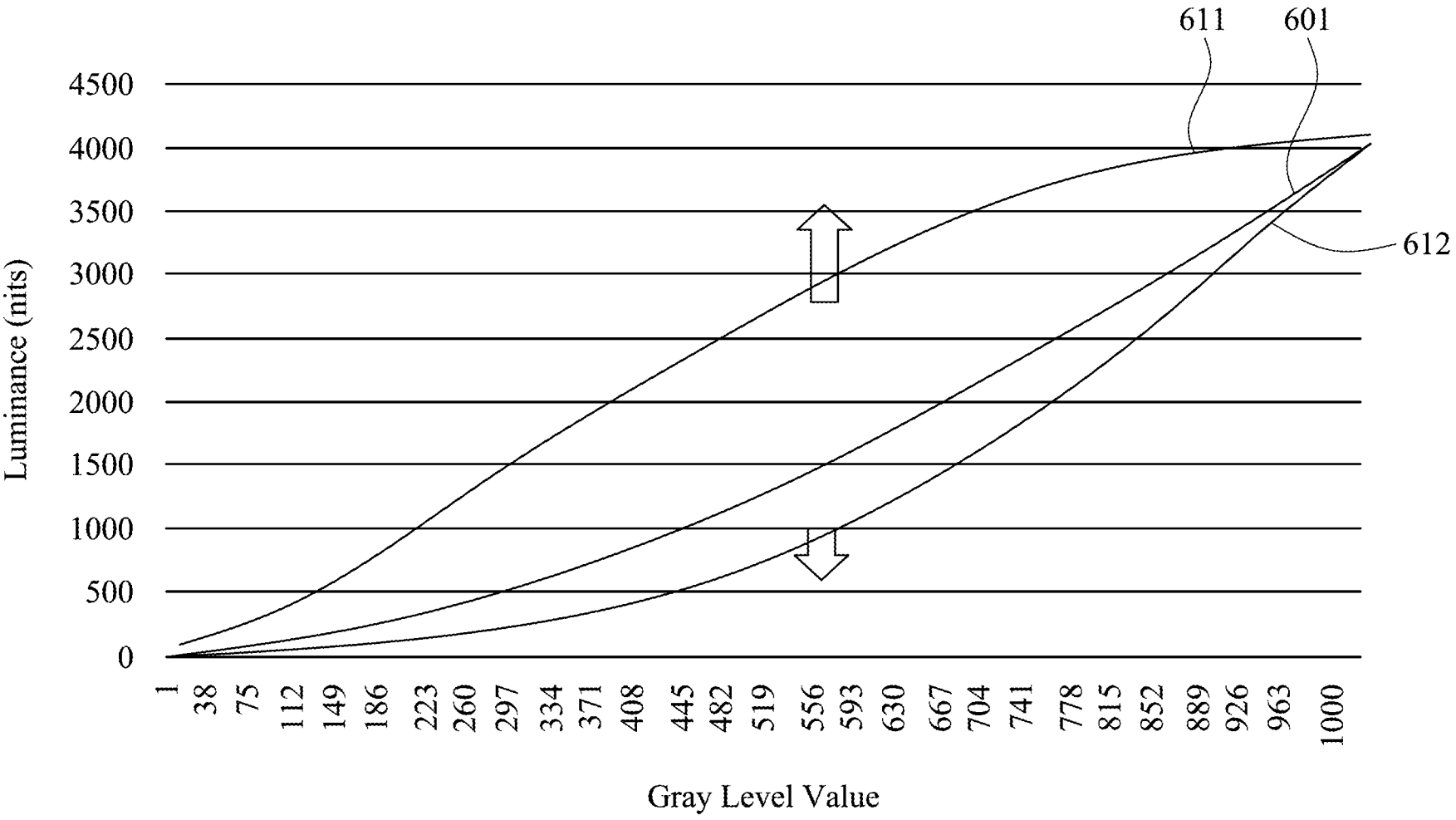
FIG. 7 provides an example for illustrating a high state curve and a low state curve according to the second embodiment of the present invention.

In the second embodiment of the present invention, the high state lookup table corresponds to a high state curve and the low state lookup table corresponds to a low state curve. FIG. 7 provides an example for illustrating the high state curve and the low state curve according to the second embodiment of the present invention. As shown in FIG. 7, a gamma curve 601 corresponds to a standard gamma curve, such as a gamma curve with a gamma value of 2.2. The high state curve 611 and the low state curve 612 are fitted to the gamma curve 601. In the second embodiment of the present invention, the high state curve 611 is implemented as the high state lookup table, and the low state curve 612 is implemented as the low state lookup table. Specifically, the composited visual effect presented by the first high pixel corresponding to the high state curve 611 and the first low pixel corresponding to the low state curve 612 is the same as the visual effect presented by pixel corresponding to the gamma curve 601.

Figure 8:
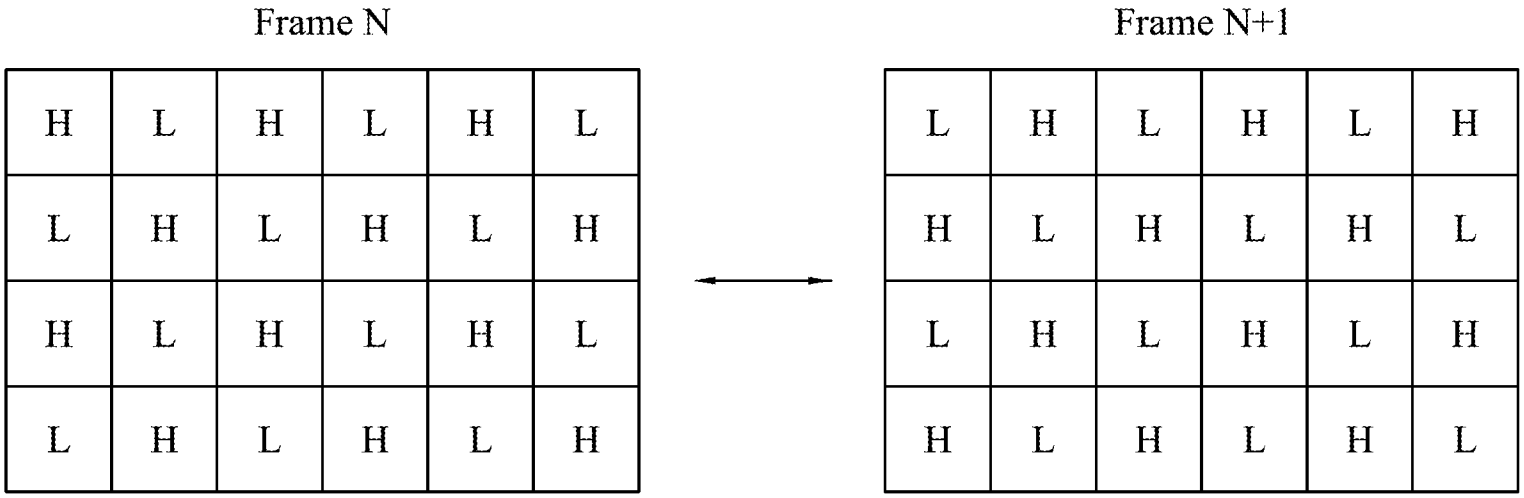
FIG. 8 provides an example of frame high/low assignment according to the first embodiment and the second embodiment of the present invention.

In the second embodiment of the present invention, besides the process of spatial high/low assignment, the dual cell dimming unit 182 may further selectively update the gray cell pixel data by a process of frame high/low assignment. The process of frame high/low assignment includes: respectively setting the first high pixel and the first low pixel of the first pixels to be in the low state and the high state in a next frame subsequent to a current frame; and updating the spatially blurring first gray level values in the next frame by decreasing the spatially blurring first gray level value of the first high pixel based on the low state lookup table and increasing the spatially blurring first gray level value of the first low pixel based on the high state lookup table so as to update the gray cell pixel data including the updated spatially blurring first gray level values in the next frame. FIG. 8 provides an example of frame high/low assignment according to the second embodiment of the present invention. As shown in FIG. 8, two tables of plural states of plural first pixels in two continuing frames (frame N and frame N+1) are presented, and the states of the same first pixel in frame N and frame N+1 are different.

From the above description, the present invention alleviate or even eliminate the moiré effect caused by light interference between the gray LCD 140 and the color LCD 120 through the dual cell dimming algorithm executed by the dual cell dimming unit 182 of the controller 180 of the dual LCD device 100. The present invention does not need to apply a diffuser sheet between the gray LCD 140 and the color LCD 120 in order to eliminate the moiré effect, and therefore the manufacturing process of the present invention may be simplifier and the present invention may save the cost of the diffuser sheet.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A dual liquid crystal display (LCD) device, comprising:

a gray LCD and a color LCD stacked one on another, wherein the gray LCD comprises a plurality of first pixels;

a backlight assembly disposed at the rear of the gray LCD and configured as a display light source for the dual LCD device; and a controller configured to receive an input image data and then respectively output a gray cell pixel data and a color cell pixel data to the gray LCD and the color LCD based on a dual cell dimming algorithm;

wherein the dual cell dimming algorithm is configured to alleviate a moiré effect caused by light interference between the gray LCD and the color LCD, wherein the dual cell dimming algorithm comprises:

calculating an initial gray cell pixel data based on the input image data, wherein the initial gray cell pixel data comprises a plurality of first gray level values respectively corresponding to the first pixels;

calculating the gray cell pixel data by spatially blurring the first gray level values of the initial gray cell pixel data, wherein the gray cell pixel data comprises the spatially blurring first gray level values;

calculating the color cell pixel data by compensating the gray cell pixel data;

setting a first high pixel and a first low pixel of the first pixels to be in a high state and a low state, respectively, wherein the first high pixel and the first low pixel are adjacent to each other; and updating the spatially blurring first gray level values by increasing the spatially blurring first gray level value of the first high pixel based on a high state lookup table and decreasing the spatially blurring first gray level value of the first low pixel based on a low state lookup table, so as to update the gray cell pixel data comprising the updated spatially blurring first gray level values.

2. The dual LCD device of claim 1, wherein the color LCD comprises a plurality of second pixels, wherein the input image data comprises a plurality of second gray level values respectively corresponding to the second pixels, wherein one of the first gray level values corresponding to one of the first pixels is an average of the second gray level values corresponding to the second pixels overlapping the one of the first pixels.

3. The dual LCD device of claim 1, wherein the spatially blurring the initial gray cell pixel data comprises:

selecting a block including n*n first pixels of the gray LCD with one of the first pixels in a center of the block, wherein n is an odd integer larger than 1;

multiplying the first gray level values of the first pixels within the block by n*n weighted values of a weighting table, respectively, thereby obtaining a plurality of weighted first gray level values; and dividing a sum of the weighted first gray level values by a sum of the weighted value so as to obtain one of the spatially blurring first gray level values of the one of the first pixels.

4. The dual LCD device of claim 3, wherein one of the weighted values located at a first position of the weighting table is larger than another one of the weighted values located at a second position of the weighting table, wherein the first position is closer to a center of the weighting table than the second position.

5. The dual LCD device of claim 1, wherein the high state lookup table corresponds to a high state curve and the low state lookup table corresponds to a low state curve, wherein the high state curve and the low state curve are fitted to a gamma curve.

6. The dual LCD device of claim 1, wherein the dual cell dimming algorithm further comprises:

respectively setting the first high pixel and the first low pixel of the first pixels to be in the low state and the high state in a next frame subsequent to a current frame; and updating the spatially blurring first gray level values in the next frame by decreasing the spatially blurring first gray level value of the first high pixel based on the low state lookup table and increasing the spatially blurring first gray level value of the first low pixel based on the high state lookup table so as to update the gray cell pixel data comprising the updated spatially blurring first gray level values in the next frame.

* * * * *